US009962600B1

(12) United States Patent
Kalamdaryan

(10) Patent No.: US 9,962,600 B1
(45) Date of Patent: May 8, 2018

(54) CUE STICK WITH EXTENSIONS

(71) Applicant: Vartan Kalamdaryan, Los Angeles, CA (US)

(72) Inventor: Vartan Kalamdaryan, Los Angeles, CA (US)

( * ) Notice: Subject to any disclaimer, the term of this patent is extended or adjusted under 35 U.S.C. 154(b) by 0 days. days.

(21) Appl. No.: 14/267,804

(22) Filed: May 1, 2014

(51) Int. Cl.
*A63D 15/08* (2006.01)

(52) U.S. Cl.
CPC ..... *A63D 15/086* (2013.01)

(58) Field of Classification Search
CPC ..... A63D 15/08; A63D 15/086; B25G 3/30; Y10T 16/4719; Y10T 403/56; A63C 11/221; A63B 60/28
USPC ..... 473/44–48, 288, 296; 280/823; 43/18.1 CT; 403/299–301, 308
See application file for complete search history.

(56) References Cited

U.S. PATENT DOCUMENTS

| | | | | |
|---|---|---|---|---|
| 3,232,613 | A * | 2/1966 | Laube, Jr. | 473/47 |
| 5,927,894 | A * | 7/1999 | Zavaglia | 403/299 |
| 6,712,712 | B2 * | 3/2004 | Bourque | 473/46 |
| 7,241,226 | B2 * | 7/2007 | Costain | A63D 15/08 473/44 |
| 2007/0060406 | A1 * | 3/2007 | Miki | 473/44 |
| 2012/0094778 | A1 * | 4/2012 | Miki | 473/44 |
| 2013/0165244 | A1 * | 6/2013 | Larson | A63D 15/08 473/44 |

* cited by examiner

*Primary Examiner* — Melba Bumgarner
*Assistant Examiner* — Laura L Davison
(74) *Attorney, Agent, or Firm* — Roy L Anderson

(57) ABSTRACT

A cue stick is fitted with an extension adapter secured in its butt end having an external extension connector adapted to matingly engage with an internal extension connector of an extension to secure the extension to the butt end. The external extension connector is not covered by the bumper and can be left on when the extension is fitted to the cue stick, but when the extension is secured, the extension and butt end of the cue stick will be substantially flush with each other, the external extension connector now being located inside of the extension.

18 Claims, 3 Drawing Sheets

CUE STICK WITH EXTENSIONS

FIELD OF THE INVENTION

The present invention is in the field of cue sticks for playing pool.

BACKGROUND OF THE INVENTION

There are times when it is desirable to make a cue stick longer by use of an extender, an example of which is U.S. Pat. No. 6,712,712.

The present invention discloses a novel cue stick which can receive one or more extensions quickly and still have a solid and professional feel to the resultant extended cue stick.

SUMMARY OF THE INVENTION

The present invention is generally directed to a cue stick, or a kit for modifying a cue stick, in which an extension adapter is secured in the butt end of the cue stick. The extension adapter has an external extension connector (such as threads) which is not covered by the bumper and is adapted to matingly engage with an internal extension connector of an extension to secure the extension to the butt end. When the extension adapter is secured to the butt end, the outer diameters of the butt and the extension will be substantially the same and flush with each other, while the external extension connector will no longer be visible. The extension can have its own bumper, and multiple extensions can be fitted together. It is not necessary to remove any bumper when one or more extensions are fitted to the cue stick and an extension bumper will still protect the end most distant from the tip.

It is therefore a primary object of the present invention to advance an improved cue stick for playing pool with one or more extensions.

This and further objects and advantages will be apparent to those skilled in the art in connection with the drawings and the detailed description of the invention set forth below.

BRIEF DESCRIPTION OF THE DRAWINGS

FIG. 3 is a cross sectional view of an extension adapter for use in the present invention while

FIG. 7 is a cross sectional view of a cue stick fitted with one extension adapter that will not accept a second extension adapter while

DETAILED DESCRIPTION OF THE INVENTION

The present invention discloses a cue stick which can be fitted with one or more extensions. The extensions are fitted easily and securely due to use of an extension adapter that is fitted into the butt end of the cue stick having an external extension connector that is visible and accessible without need for removing the bumper. When an extension is matingly attached, the outer circumference of the butt and the extensions are flush so that the resultant extended cue stick feels like a longer cue stick.

In the Figures and the following more detailed description, numerals indicate various features of the invention, with like numerals referring to like features throughout both the drawings and the description.

Although the Figures are described in greater detail below, the following is a glossary of the elements identified in the Figures.

Figure 1:
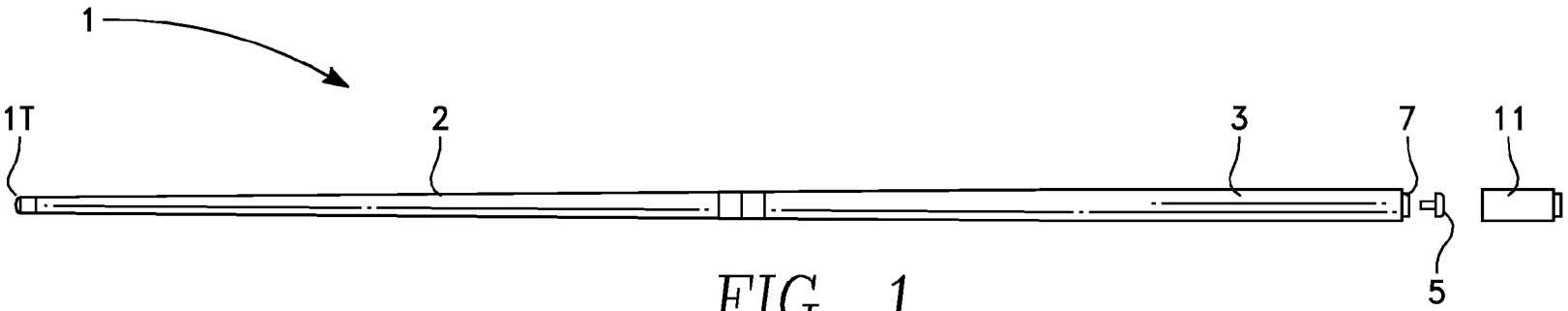
FIG. 1 is a plan view of a cue stick fitted with an extension adapter according to the present invention.
Figure 2:
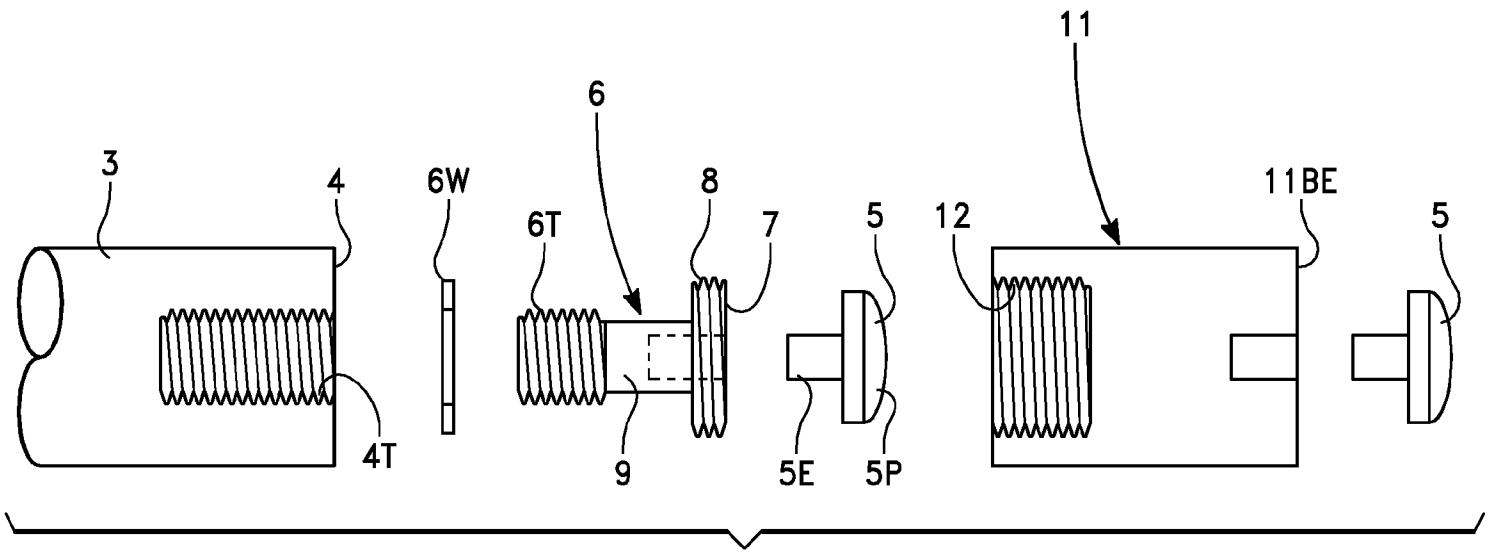
FIG. 2 is a plan view partial assembly drawing of a cue stick with an extension according to the present invention.
Figure 3:
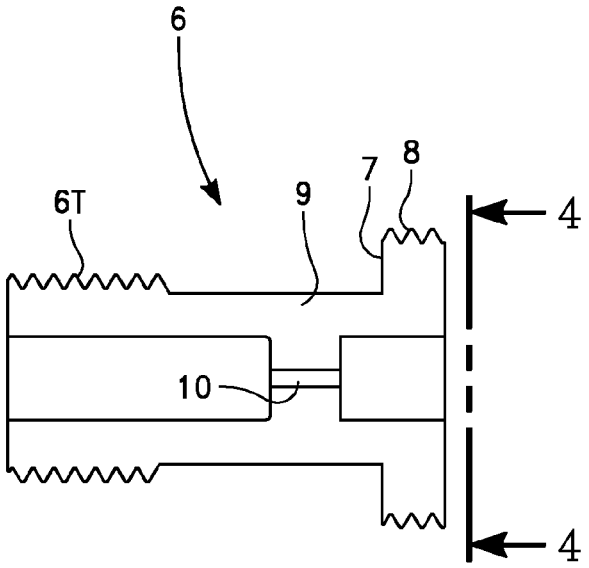

1 cue stick
1T tip
2 shaft
3 butt
4 butt end
4T internal butt end threads
5 bumper
5E bumper extension
5P bumper protection
6 extension adapter
6T extension adapter external threads
6W extension adapter washer
7 external extension connector
8 external extension connector threads
9 extension adapter shaft
10 screwdriver slot
11 extension
11A extension fitted to receive another extension
11 BE butt end of extension 11
11 EC butt end external extension connector of extension 11
12 internal extension connector A cue stick (or pool cue) 1, shown generally in FIG. 1, has a shaft 2 and a butt 3; the shaft and butt may be one piece or two pieces. Butt 3 has a bumper 5 on its end, located distant from tip 1T. Bumper 5 is inserted into butt end 4. Bumper 5 has a bumper extension 5E for holding it in butt end 4 (either by thread connections, force fit or another securing mechanism) while bumper protection 5P protects butt end 4 of the cue stick.

In accordance with the present invention, an extension adapter 6 is inserted into and secured into butt end 4, where it is firmly secured, and bumper 5 is then inserted into and held by extension adapter 6. Extension adapter 6 can have external threads 6T for screwing it into butt end 4 and holding it in place and, in an especially preferred embodiment, has a washer 6W which can be made of many substances, such as plastic or leather. It is especially preferred that extension adapter 6 be made of aluminum while washer 6W is made of a non-metallic material so as to avoid the sound of sound of metal to metal contact. Extension adapter 6 has an external extension connector 7, an example of which is threads 8, that extend out of butt end 4 and are visible when bumper 5 is secured. Extension adapter 6 has a shaft 9 for receiving bumper extension 5E and, in an especially preferred embodiment, has screwdriver slot 10 for aiding insertion of extension adapter 6 into butt end 4 by means of a turning action.

Figure 4:
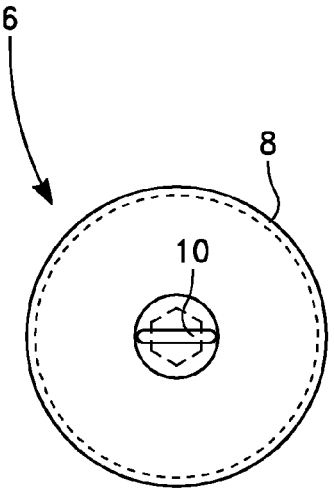
FIG. 4 is top plan view taken along line 4-4 of FIG. 3.
Figure 5:
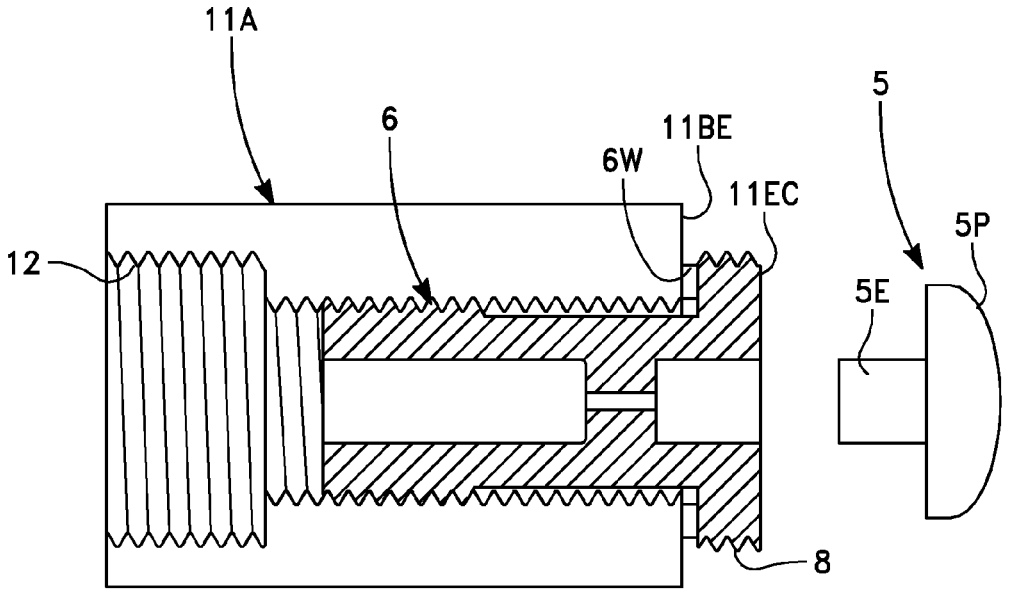
FIG. 5 is a cross sectional view of an extension according to the present invention shown in FIG. 2 that is fitted with its own extension adapter.
Figure 6:
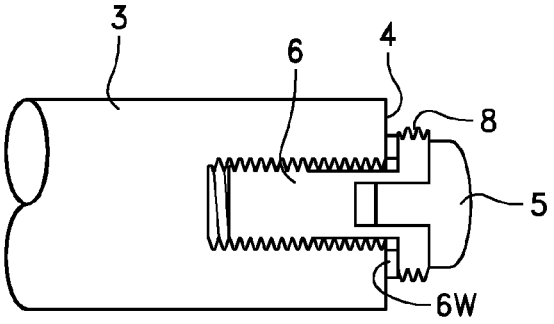
FIG. 6 is a plan view cutaway of the cue stick of FIG. 1 fitted with one extension adapter according to the present invention.
Figure 7:
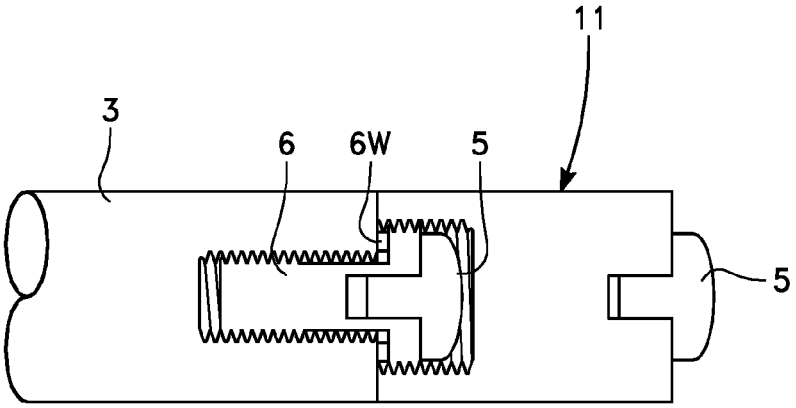

Note that while slot 10 is depicted in FIG. 4 as being a single slot, in connection with the present invention, "screwdriver slot" is meant to mean any slot that can be engaged by a tool designed to fit into it to thereby allow a torque to be applied to extension adapter 6 to drive it into butt end 5;

accordingly, a screwdriver slot might also have many other common shapes, such as that of a cross-recess, a cruciform type (such as what might be found on a Phillips, Frearson, French Recess, Mortorq, Pozidriv, Supadriv or Robertson screw drive) or a square, hex, or pentagon shape.

Note also that while extension adapter 6 can be screwed into butt end 4 in an especially preferred embodiment (which might also utilize corresponding mating threads 4T located inside of butt end 4), other ways of securing extension adapter 6 to butt end 4 are also possible, and contemplated to be within the scope of this invention, such as using a press fit or glue (which is not especially desirable), the important point being that extension adapter 6, in normal use, is secured (even if removably) to butt end 4, with external extension connector 7 being visible and engageable by an extension 11.

An extension 11 is added to cue stick 1 by matingly engaging an internal extension connector 12 of extension 11 to external extension connector 7 to thereby firmly secure and hold extension 11 in place as an extension of cue stick 1 when external extension connector 7 and internal extension connector 12 are matingly engaged. It is especially preferred that the outer diameter of external extension connector 7 be maximized with respect to the outer diameter of butt 3 at its butt end 4 so as to create a more firm and secure mating connection over a wider area, thus promoting a more solid feel by a person using the extended cue stick. When extension 11 is so engaged, note that the end of extension 11 most distant from tip 1T will now function, in essence, as a new butt end of the extended cue stick. Accordingly, it is especially preferred that butt end 11BE be designed and configured so that it will accommodate and receive its own bumper 5, which may be of the same shape or a different shape, as bumper 5 secured in butt end 4, and such an extension 11A is shown in FIG. 8.

Figure 8:
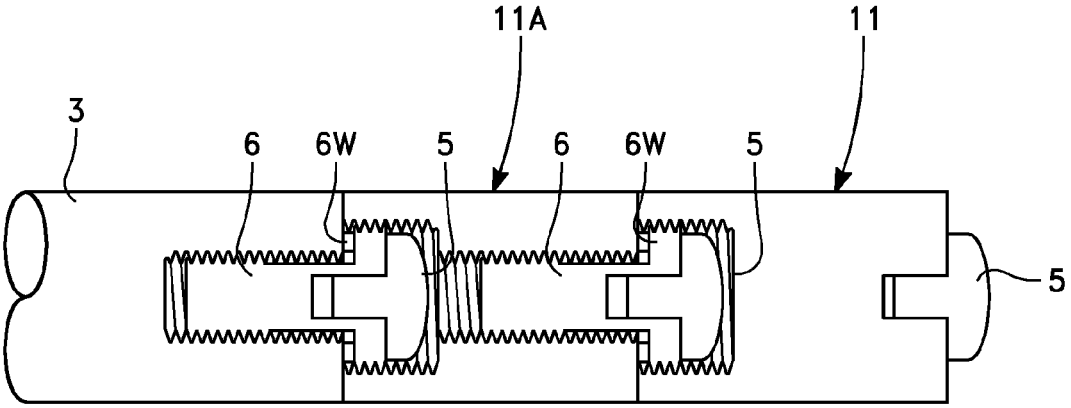
FIG. 8 is a cross sectional view fitted with two extension adapters.

It is also preferred, in an especially preferred embodiment, that multiple extensions 11 can be connected together, as depicted in FIG. 8. In such an embodiment, the first extension 11A matingly engaged to butt end 4 can be configured so that its butt end 11 BE is configured to receive its own extension adapter 6. In this embodiment, which can also be accomplished by adding an extension adapter 6 into extension butt end 11 BE, extension butt end 11 BE has its own butt end external extension connector 11 EC which itself can then connect to an internal extension connector 12 of another extension 11, thus allowing multiple extensions 11 to be connected together and function in a similar fashion as a single extension 11 of the same length as the multiple extensions.

Whether one or more than one extensions are added to a cue stick, once they are added, the outside diameter of the cue stick where an extension is matingly engaged with a butt end will be substantially flush and, in this assembled state, the external extension connector used to create the mating, flush fit, will no longer be visible, so that the extended cue stick will look and feel as if it is a solid, longer, cue stick.

It is especially preferred that extensions 11 be made of machined aluminum that has been machined to provide grip surfaces and the resultant extension is then coated or electroplated with a paint, such as, for example, a black paint.

While the invention has been described herein with reference to certain examples, those examples have been presented for illustration and explanation only, and not to limit the scope of the invention. Additional modifications and examples thereof will be obvious to those skilled in the art having the benefit of this detailed description. Therefore, further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. A cue stick, comprising:

a shaft connected to a butt, the shaft having a tip end and the butt having a butt end having a butt end outer diameter;

an extension adapter secured in the butt end, said extension adapter having an external extension connector which extends outwardly from the butt end and which has an external extension connector outer diameter that is less than the butt end outer diameter; and a bumper held in the external extension connector, said bumper having a maximum outer bumper diameter which is less than the external extension connector outer diameter;

wherein the external extension connector is configured to matingly engage with an internal extension connector of a first extension having an internal extension connector diameter which is greater than the maximum outer bumper diameter to matingly secure the first extension to the butt end while the bumper is held in the external extension connector.

2. The cue stick of claim 1, further comprising an extension adapter washer secured between the butt end and the external extension connector.

3. The cue stick of claim 1, wherein the extension adapter has at least one thread for engaging with a corresponding thread in the butt end so that the extension adapter can be screwed into the butt end.

4. The cue stick of claim 1, where the extension adapter has a screwdriver slot configured for engaging a tool designed to fit into the slot to thereby allow a torque to be applied to the extension adapter to drive the extension adapter into the butt end.

5. The cue stick of claim 1, further comprising the first extension matingly secured to the butt end.

6. The cue stick of claim 5, wherein the first extension has a first extension outer diameter that is substantially the same as the butt end outer diameter.

7. The cue stick of claim 6, wherein a second bumper is held in the first extension.

8. The cue stick of claim 7, wherein the second bumper has a second maximum outer bumper diameter which is less than the first extension outer diameter.

9. The cue stick of claim 8, further comprising a second extension matingly secured to the first extension while the second bumper is held in the first extension.

10. The cue stick of claim 9, further comprising a third bumper secured to the second extension.

11. The cue stick of claim 1, wherein the shaft and the butt comprise a single piece.

12. The cue stick of claim 1, wherein the shaft and the butt comprise two pieces.

13. An extension kit for a cue stick having a shaft and a butt, a tip connected to a tip end of the shaft and a bumper end opposite the tip, said butt having a butt end with a butt end outer diameter, comprising:

an extension adapter configured to be secured in the butt end, said extension adapter having an external extension connector which extends outwardly from the butt end and which has an external extension connector outer diameter that is less than the butt end outer diameter when the extension adapter is secured in the butt end;

a bumper held in the external extension connector, said bumper having a maximum outer bumper diameter which is less than the extension connector outer diameter; and a first extension with an internal extension connector having an internal extension connector diameter which is greater than the maximum outer bumper diameter;

wherein the external extension connector is configured to matingly engage with the internal extension connector to matingly secure the first extension to the butt end while the bumper is held in the external extension connector.

14. The extension kit of claim 13, wherein the first extension has a first extension outer diameter that is substantially the same as the butt end outer diameter.

15. The extension kit of claim 14, wherein a second bumper is held in the first extension.

16. The extension kit of claim 15, wherein the second bumper has a second maximum outer bumper diameter which is less than the first extension outer diameter.

17. The extension kit of claim 16, further comprising a second extension with a second internal extension connector which is configured to matingly secure said second extension to the first extension while the second bumper is held in the first extension.

18. The extension kit of claim 17, further comprising a third bumper secured to the second extension.

* * * * *